US008602684B2

(12) United States Patent
Aufleger et al.

(10) Patent No.: US 8,602,684 B2
(45) Date of Patent: Dec. 10, 2013

(54) ARRANGEMENT FOR PRODUCING LINEAR STANDING WAVES

(76) Inventors: Markus Aufleger, Beuerberg/Erasburg (DE); Ulrich Hautzel, Cologne (DE); Derek O'neill, New South Wales (AU); Roland Hoepffner, München (DE)

( * ) Notice: Subject to any disclaimer, the term of this patent is extended or adjusted under 35 U.S.C. 154(b) by 508 days.

(21) Appl. No.: 12/442,433

(22) PCT Filed: Sep. 21, 2007

(86) PCT No.: PCT/EP2007/008251

§ 371 (c)(1),
(2), (4) Date: Oct. 20, 2009

(87) PCT Pub. No.: WO2008/034631

PCT Pub. Date: Mar. 27, 2008

(65) Prior Publication Data

US 2011/0116870 A1 May 19, 2011

(30) Foreign Application Priority Data

Sep. 22, 2006 (DE) ..... 10 2006 044 806

(51) Int. Cl.
*A47K 3/10* (2006.01)

(52) U.S. Cl.
USPC ..... 405/79; 4/491

(58) Field of Classification Search
USPC ..... 405/76, 77, 79; 4/491
See application file for complete search history.

(56) References Cited

U.S. PATENT DOCUMENTS 3,981,612 A * 9/1976 Bunger et al. ..... 416/66
4,909,666 A * 3/1990 Takasaki ..... 405/115
5,417,550 A * 5/1995 Kasai et al. ..... 417/151
5,421,782 A 6/1995 Lochtefeld
2005/0207845 A1 * 9/2005 McFarland ..... 405/79

FOREIGN PATENT DOCUMENTS

DE 69310719 T2 10/1997
DE 200 19 358 U1 4/2001
DE 691 14 013 T3 4/2002

(Continued)

OTHER PUBLICATIONS

Hornung, H.G.et al.; "A stationary oblique breaking wave for laboratory testing of surfboards"; Journal of Fluid Mechanics; 1976; 26 pgs.

(Continued)

*Primary Examiner* — Benjamin Fiorello
(74) *Attorney, Agent, or Firm* — Gifford, Krass, Sprinkle, Anderson & Citkowski, P.C.

(57) ABSTRACT

The arrangement for producing linear standing waves includes: a transverse structure arranged at least substantially perpendicularly to the flow direction, the structure designed such that the outflow is converted from a streaming flowing movement into a shooting flowing movement; a ramp connected downstream to the transverse structure and arranged at least substantially perpendicularly to the flow direction; a counter-ramp arranged at least substantially in the flow direction at the downstream end of the ramp and the average inclination in the flow direction forms an angle to the horizontal in the flow direction, and which has a flow-promoting transition to the ramp at its upstream end; a base arranged downstream of the ramp and the counter-ramp and whose bottom is arranged lower by a height dimension than the downstream end of the ramp and/or the upstream end of the counter-ramp.

19 Claims, 2 Drawing Sheets

(56) References Cited

FOREIGN PATENT DOCUMENTS

| | | | |
|---|---|---|---|
| DE | 101 02 805 | A1 | 5/2002 |
| DE | 103 08 812 | A1 | 9/2004 |
| EP | 0 629 139 | B1 | 5/1997 |
| EP | 0 547 117 | B2 | 9/2001 |
| WO | 02/083256 | | 10/2002 |
| WO | 2004/076779 | | 9/2004 |

OTHER PUBLICATIONS

Paine, Michael; "Hydrodynamics of Surfboards"; 1974; 10 pgs.

"Production of waves and rollers for canoeing"; Report of the Institute for Waterways of the German Armed Forces University in Neubiberg on behalf of the Bayer Canoe Association; Mar. 2004; 38 pgs.

* cited by examiner

ARRANGEMENT FOR PRODUCING LINEAR STANDING WAVES

CROSS-REFERENCE TO RELATED APPLICATIONS

This application is the U.S. national phase of international patent application PCT/EP2007/008251 filed Sep. 21, 2007, which claims priority to German patent application DE 10 2006 044 806.5 filed Sep. 22, 2006.

FIELD OF THE INVENTION

The invention relates to an arrangement for producing linear standing waves in a flowing medium, especially in flowing water.

BACKGROUND OF THE INVENTION

The production of standing waves in a flowing medium is known especially from the field of hydraulic engineering. Therefore, water is subsequently considered as a flowing medium.

Standing waves are often an unintended result of hydraulic-engineering plants or natural features or the result of intentional flow guidance in artificial constructions. Standing waves are much used by wave riders and canoeing sportsmen, among others.

One must differentiate between linear standing waves and breaking standing waves. Linear standing waves are characterized by a two-dimensional flow guidance and remain almost unchanged along an axis perpendicular to the direction of flow. Breaking standing waves can be produced only by a complex three-dimensional flow guidance.

The production of breaking standing waves is known from the German patent application DE 103 08 812 A1. The arrangement described there for producing standing waves in flowing water comprises a transverse structure arranged approximately perpendicular to the flow direction, a curved guide ramp that adjoins said structure upstream with contour lines that form an angle with the ramp, the acuteness of said angle increasing in the flow direction, and also a height-adjustable wave-generating body located downstream of the guide ramp, said wave-generating body being placed diagonally to an angle of attack relative to the flow direction. The arrangement is especially suitable for producing standing, especially breaking waves. The arrangement is incapable of producing linear standing waves due to the complex, three-dimensional flow guidance. The movable wave generating body is found directly below the standing waves in this arrangement. The arrangement of an unchanging wave-producing installation (wave generator) which is found directly below the standing waves is the objective of the German utility model application DE 200 19 358 U1 and also the German laid-open patent DE 101 02 805 A1. Arrangements that are similar in principle in laboratory systems or test channels are the objective of the international publications ("A stationary oblique breaking wave for laboratory testing of surfboards" by H. G. Hornung and P. Killen, Journal of Fluid Mechanics, 1976: "Hydrodynamics of Surfboards," by Michael Paine, 1974. In the proprietary publications EP 0 547 117 B2 (DE 691 14 013 T3) and EP 0 629 139 B1 (DE 693 10 719 T2), devices for producing wave-like water surfaces of lower water depth and higher speed in artificial leisure devices are described. Here, a planar flow is produced that directly contacts a wave-shaped body. The installations that are conceptualized for flowing water according to the utility model DE 200 19 358 U1 and also the laid-open patent DE 101 02 805 A1 cannot produce waves for leisure activities with quality like that of devices with artificially produced flow.

It is known that inclined ramps with a height offset arranged downstream are suitable for producing linear standing waves, especially in the direction of flow (among others, e.g., from: "Production of waves and rollers for canoeing," Report of the Institute for Waterways of the German Armed Forces University in Neubiberg on behalf of the Bayer Canoe Association, March 2004). Here, the wave formation in particular is induced by the abrupt delay of flow at the transition between the shooting flow movement on the ramp (Froude number >1) and a slower streaming flow movement downstream of the ramp (Froude number <1). Here, the water surface height beneath the device is of special importance for the formation of a standing wave.

SUMMARY OF THE INVENTION

The task of the invention is in particular to produce a linear standing wave for leisure and sport activities in an optimized way. Another task is to specify options for the control of wave form and wave height. Additionally, the task of the invention is to avoid dangerous flow situations in connection with the linear standing wave. The task based on the invention can comprise one solution for many individual tasks mentioned within the scope of the invention, or even a summary solution for many or all of the tasks mentioned.

This problem is solved according to the arrangement having the advantageous embodiments and improvements described herein.

The invention is based on the assumption that the existence and shape of linear standing waves are determined to a large extent by the geometry of the contour guiding the flow.

The arrangement according to the invention for producing linear standing waves in a flowing medium comprises a transverse structure which is arranged at least substantially perpendicular to the flow direction, this structure being designed such that the outflow is converted from a streaming flowing movement (Fronde number <1) into a shooting flowing movement (Fronde number >1), a ramp which is connected downstream of this transverse structure and which is arranged at least substantially inclined in the flow direction or perpendicular to the flow direction, a counter-ramp which is arranged at least substantially in the flow direction at the downstream end of this ramp, whose average inclination in the flow direction forms an angle to the horizontal in the flow direction and which has a flow-promoting transition to the ramp at its upstream end, a base which is arranged downstream of the ramp and the counter-ramp, whose bottom is arranged lower by a height dimension than the downstream end of the ramp and/or upstream end of the counter-ramp, a height-adjustable flow-guiding element, which is arranged at least approximately perpendicular to the flow direction in the downstream region of the base, that directs the flow such that no eddies are produced there having pronounced flow components counter to the main flow in the flow direction.

The conversion of outflow in the region of the transverse structure from a streaming into a shooting flowing movement means a transition of the flow state from a Fronde number with a value less than 1 to a Froude number with a value greater than 1.

The wave can be controlled in the sense of the invention by the mobility of the contour guiding the flow. This mobility of the contour is achieved by the adjustability of the ramp and/or the counter-ramp. The flow subsequent to the linear standing wave is controlled by the flow-guiding element in its basic embodiment.

Therefore, the ramp is advantageously adjustable in its inclination in the flow direction. The inclination of the ramp in the flow direction can therefore be adjusted between a smallest mean slope of 1:20 to 1:18 and a maximum mean slope of 1:8 to 1:1.

The ramp can have a constant slope in the flow direction or a decreasing slope. Moreover, a combination of constant slope and decreasing slope is possible.

As already mentioned, the mobility of the contour guiding the flow can also be achieved if the counter-ramp is adjustable in its slope in the flow direction. Advantageously, in that case the angle of the mean slope of the counter-ramp to the horizontal in the flow direction can be adjusted between a smallest angle of −45° to 0° and a largest angle of 15° to 90°.

In the embodiment of the invention, the flow-facing side of the counter-ramp can have a constant or increasing inclination in the flow direction.

In another embodiment of the invention, the flow-guiding element can be adjusted from a minimum height of 0 to 0.5 times the height of the height dimension up to a maximum height of 0.6 to 1.5 times the height of the elevation above the base.

In all, the adjustability can be specified individually as well as with cumulative options by the options mentioned in order to produce the desired linear standing wave in a suitable way, and it can also be varied. Therefore, the invention has valuable applications in the field of leisure and sports activities.

In a development of the invention, the ramp can comprise a wall on the upstream side, a fixed plate hinged on this ramp, and a plate height adjustment mechanism. In that case, the height of the wall of the ramp on the upstream side can be adjusted. Furthermore, the counter-ramp can have a fixed, plate-like structure hinged on the downstream end of the ramp and an angle adjustment mechanism. In that case, a flexible plate-like structure can be advantageously arranged in the flow direction over the rigid plate-like structure of the counter-ramp, which structure has a tangential transition to the plate-like structure of the ramp at its upstream end.

Within the scope of the invention it is possible for the counter-ramp to have a tubular element that can change its shape due to internal pressurization. A suitable shape is formed according to the choice of internal pressure, and the contour of the shape-changing tubular element is also developed. The tubular element can be filled with any suitable fluid. Water or air can be considered for this purpose.

In the embodiment of the invention, the flow-guiding element can have a rigid structure which is hinged at its upstream end on the base, and this element also comprises a height adjustment mechanism. The height of the flow-guiding element can be adjusted with the help of the height adjustment mechanism.

It is also possible for the flow-guiding element to have a tubular element which can change its shape due to internal pressurization. Here also, a suitable shape and contour of the shape-changing tubular element is formed according to the choice of internal pressure. The tubular element can in this case be filled with any suitable fluid. For example, water or air can be considered. The flow-guiding element can be made up partially or even preferably completely with a tubular element which is internally pressurized.

Another option for adjustability for the linear standing wave to be produced is achieved according to the invention such that the flow-guiding element is located on a horizontal plate that can be displaced along the base in the flow direction, which allows suitable positioning of the flow-guiding element in the flow direction.

In a development of the invention, flow-affecting structures can be arranged on the flow-delimiting lateral surfaces of the arrangement in the vicinity of the counter-ramp. These structures reduce the flow speeds at the boundaries of the standing wave.

Local flow separation can be caused due to the incorporation of flow-disturbing or flow-affecting structures on the side walls that delimit the flow. These cause local surface disturbances and turbulences on the upstream side of the linear standing wave, leading to local reduced flow speeds in the proximity of the side walls. These can be very advantageous with regard to safety as well as running.

Preferably, the incorporation of flow-affecting structures which reduce the flow speeds of standing waves can also be selectively provided in the main flow in the vicinity of the counter-ramp. With a selective arrangement (singly or multiply) of flow-affecting structures in the region of the main flow, additional advantages or increased attractiveness can be achieved especially in view of application in the framework of leisure and sports activities. The flow-affecting structures in the region of the main flow can help in variation of the wave for increased safety, in use with respect to maneuvering to change direction (for example, for producing regions of flow conditions that promote maneuvering), in dividing into different areas (for example, into two or more areas parallel in the flow direction), and basically for expanded variability of the wave.

In the scope of the invention, it can be assumed that means are provided to supply compressed gas, especially air, in the form of gas bubbles in the flowing medium in the region of the ramp and/or a little above the transverse structure by means of which the nature of the linear standing wave changes in the subsequent region in the flow direction. The nature of the linear standing wave can be appropriately influenced and selected by suitable addition of the compressed gas or preferably air. In that case it is possible for the means for supplying the compressed gas to be designed such that supply is performed in the vicinity of the ramp and/or a little above the transverse structure at different times at alternating positions.

The nature of the standing wave can be varied by local supply of air bubbles or gas bubbles in the vicinity of the ramp. The air bubbles change the density and viscosity of the flowing medium, and thus lead to local variabilities. In this way, zones can be produced with slightly reduced flow speeds, which are of special interest for changing directions for surfers.

The arrangement according to the invention described above is especially suitable for application in the production of linear standing waves in a natural and/or artificial water flow. In that case, it can be used in leisure and sports activities.

Experimental trials by the inventors prove that the character of the linear standing waves is significantly determined due to the specific outflow, i.e., the outflow per meter of width of the arrangement. The adjustability of the flow-guiding contour with respect to the invention ensures that optimization of the shape of the standing waves, and also of the flow situation subsequent to the wave, can be effected even for alternating outflows.

Typically, for wave heights of about 0.5 m to 2.0 m, linear standing waves suitable for the application mentioned are between 1.0 $m^3$/sm and 3.0 $m^3$/sm. The length of the ramp is typically about 4.0 m to 12.0 m.

The imperatively high outflows on the ramp and their limited lengths generally have the effect that no stationary steady flow process comes about on the ramp. The flow is always still accelerating. Therefore, the energy content of the flow at the downstream foot of the standing wave can be controlled by adjusting the ramp. The steeper the inclination of the ramp, the larger the height difference is between the energy curve in the head water and the downstream end of ramp.

The direction of flow at the upstream foot of the linear standing wave can be controlled by the inclination of the counter-ramp, which is described by an angle to the horizontal in the flow direction. The steeper the flow upwards at this point, the steeper is the upstream side of the linear standing wave. This adjustability is of great importance for the character of recreational use, and for the degree of difficulty while riding the wave.

Often, roller-shaped flow structures are formed subsequent to the standing wave with distinct flow components counter to the flow direction. These can lead to great danger to the user of the standing waves since these users cannot escape these rollers, depending on the force of the flow and personal ability. The flow plunging in the direction of the bottom in direct connection to the linear standing wave is again guided upwards by a flow-guiding element. Dangerous rollers can thus be prevented. Therefore, an adjustable flow-guiding element is advantageous according to the invention for avoiding dangerous flow structures with distinct flow components counter to the flow direction subsequent to the ramp.

Depending on the construction and/or the local conditions, arbitrary combinations of the variants, embodiment variations and/or layouts can also be undertaken for the current arrangement according to the invention for the production of linear standing waves.

BRIEF DESCRIPTION OF THE DRAWINGS

The invention is explained in the following with the help of several embodiments shown in the drawings. In this case, the drawings contain partially simplified representations.

They show:

FIG. 1*a*: in plan view and

FIG. 1*b*: according to the longitudinal section A-A from the plan view of FIG. 1*a*.

DETAILED DESCRIPTION OF THE INVENTION

Figure 1:
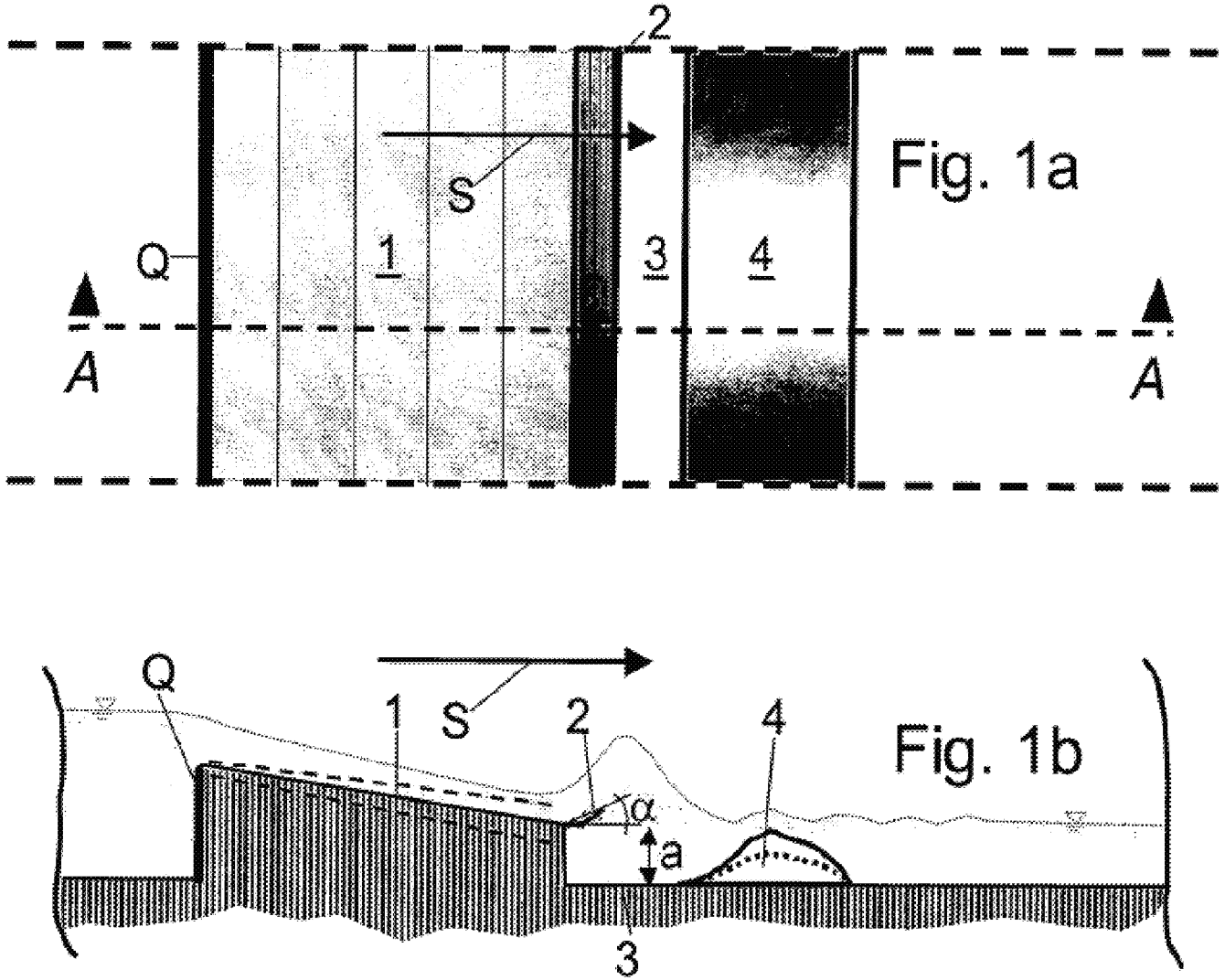
FIG. 1 is the overall design of an installation with the inventive arrangement for producing linear standing waves with the respective representations.

FIG. 1 is a simplified depiction of the overall design of an installation for producing linear standing waves. In both the plan view according to FIG. 1*a* and the section along A-A in FIG. 1*b*, the inventive arrangement for producing linear standing waves in the flow direction S comprises a transverse structure Q, a ramp 1, a counter-ramp 2, a base 3 and a flow-guiding element 4. The longitudinal section in FIG. 1*b* is a section at position A-A in the plan view of FIG. 1*a*.

The counter-ramp 2, which is arranged at least substantially in the flow direction S at the downstream end of ramp 1, has an average inclination in the flow direction S with an angle α to the horizontal in the flow direction S. The counter-ramp 2 has a flow-promoting transition to the ramp 1.

The bottom of base 3 is arranged lower in FIG. 1 by a height dimension a than the downstream end of ramp 1 and the upstream end of counter-ramp 2.

Figure 2:
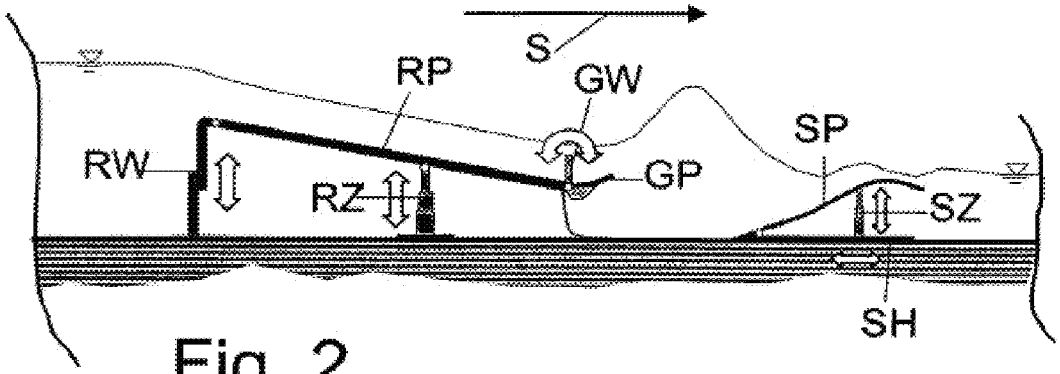
FIG. 2 is an installation with the inventive arrangement for producing linear standing waves with adjustable geometry of the flow-delimiting contour, in longitudinal section.

FIG. 2 is a longitudinal section with an exemplary and simplified depiction of different adjustment options of the flow-delimiting contour.

The adjustability of the ramp comprises largely the adjustability of the inclination of the ramps. This can be achieved such that the ramp is formed from a rigid plate RP which—as seen in FIG. 2—is hinged on the upstream wall RW.

The inclination of the plate RP and thus the inclination of the ramp (refer to ramp 1 in FIG. 1) can be varied in the flow direction S by a height adjustment mechanism RZ for the rigid plate RP. In a typical example of a height adjustment mechanism RZ for the rigid plate RP, this mechanism RZ comprises a mechanically adjustable auxiliary device (e.g., using threaded rods) or a hydraulically adjustable auxiliary device (e.g., a hydraulic cylinder).

Furthermore, the height position of the ramp (refer to ramp 1 in FIG. 1) and thus the entire flow situation which is shaped by the inventive arrangement, can be affected by the heist adjustability of upstream wall RW. The head of the upstream wall RW is equivalent to the crest of the ramp. Its height position is determined by the adjusted height of wall RW. The upstream wall RW can consist of many, for example, two as shown in FIG. 2 oppositely displaceable wall portions.

The counter-ramp (refer to counter-ramp 2 in FIG. 1) can comprise a rigid, plate-like structure or, as shown in FIG. 2, a rigid plate GP. The rigid plate GP is hinged at the downstream end of plate RP of the ramp (refer to ramp 1 in FIG. 1).

In FIG. 2, the counter-ramp is shown next to a rigid plate GP which is hinged at the downstream end of the ramp, and additionally with an angle adjustment mechanism GW of plate GP of the counter-ramp. The angular adjustment in this case takes place as indicated by the arrow direction such that the flow situation is suitably influenced by adjusting the angle of plate GP of the counter-ramp (refer to angle α to the horizontal in the flow direction S in FIG. 1). The inclination of the rigid plate GP can be adjusted by mechanical or hydraulic actuations; these are found below the rigid plate GP or also beside the rigid plate GP. A setting device for angular adjustment mechanism GW of rigid plate GP can also be arranged laterally in the outer region of the side walls that laterally delimit the flow.

The adjustable flow-guiding element (refer to flow-guiding element 4 in FIG. 1) for avoiding dangerous flow structures in connection with the ramp can comprise a rigid, generally flow-promoting shaped structure SP, which is hinged at its upstream end. The inclination and height position of this fixed structure SP can be adjusted via a mechanical or hydraulic height adjustability mechanism SZ for rigid structure SP. This height adjustability mechanism SZ is preferably to be arranged below or beside the rigid structure SP.

The entire flow-guiding element (refer to flow-guiding element 4 in FIG. 1) can also be arranged on a plate SH which can be displaced parallel to the base. The position of the flow-guiding element can thus be particularly optimized for arrangements which must produce linear standing waves over a larger outflow area.

Figure 3:
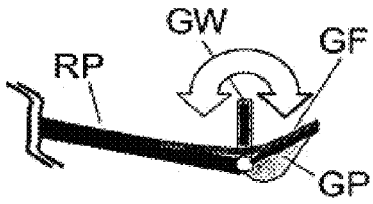
FIG. 3 is a section of the inventive arrangement with a second variant of ramp and counter-ramp.

FIG. 3 shows a section of the inventive arrangement with a second variant of the ramp (refer to ramp 1 in FIG. 1) and counter-ramp (refer to counter-ramp 2 in FIG. 1). As shown in FIG. 3, a flexible plate or a flexible plate-like structure GF can be arranged over the rigid plate GP; said flexible plate is provided for a flow-promoting shaping. For this it is necessary for the plate or plate-like structure GF which is flexible in the flow direction to have at its upstream end a tangential transition to the plate RP of the ramp. As in FIG. 2, an angle adjustment mechanism GW for plate GP or for flexible plate or plate-like structure GF of the counter-ramp is shown in FIG. 3.

Figure 4:
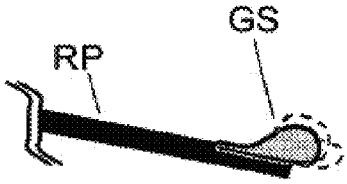
FIG. 4 is a section of the inventive arrangement with a third variant of ramp and counter-ramp.

Additionally or preferably alternatively, formation of the counter-ramp (refer to counter-ramp 2 in FIG. 1) can be done with a tubular element GS which is filled with a fluid such as water or air. As shown in FIG. 4, such a tubular element GS, which is designed as an alternative to the embodiment in FIG. 3, is arranged on the downstream end of plate RP of the ramp. A suitable shape and contour of the tubular element GS is formed according to the choice of the internal pressure of the fluid or of the inflation amount of the shape-changing tubular element GS. Different inflation states of the counter-ramp tubular element GS, which can change shape due to the internal pressurization, are shown with dashed lines. The tubular element GS must have a distinct break-away edge at its downstream end. This edge can be fanned by a fin-shaped structure.

Figure 5:
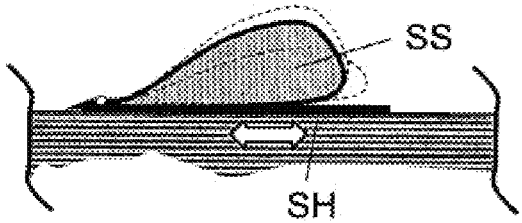
FIG. 5 is a section of the inventive arrangement with an exemplary embodiment of a flow-guiding element.

The adjustable flow-guiding element for avoiding dangerous flow structures in connection with the ramp can comprise a rigid structure of generally flow-promoting shape that is hinged at its upstream end. Additionally or preferably alternatively to the mechanical or hydraulic height adjustability mechanism SZ shown in FIG. 2, the height adjustability of a rigid structure can also be achieved with a tubular element filled with a fluid like water or air. The inclination and the height position of this rigid structure SP can be adjusted (refer to FIG. 2). Preferably, this is to be arranged below the rigid structure. Additionally or preferably alternatively to the variant shown in FIG. 2, the flow-guiding element can comprise a tubular element SS which is pressurized internally. Moreover, the flow-guiding element also can be designed completely with a tubular element SS which is pressurized internally as is shown in FIG. 5. Also shown in FIG. 5 is the embodiment already known from FIG. 2 in which the entire flow-guiding element (refer to flow-guiding element 4 in FIG. 1) is arranged on a plate SH which can be displaced parallel to the base. Different inflation states, and thus different contours of the flow-guiding element as tubular element SS, which changes its shape due to the internal pressurization, are shown with dashed lines.

The invention claimed is:

1. An arrangement for producing linear standing waves in a flowing medium having a flow direction, said arrangement comprising:

a transverse structure arranged at least substantially perpendicular to the flow direction, the transverse structure being designed such that an outflow is converted from a streaming flowing movement into a shooting flowing movement, a ramp connected downstream of the transverse structure, the ramp having an upper surface being inclined at least substantially in the flow direction, a counter-ramp arranged at least substantially in the flow direction at a downstream end of the ramp, the counter-ramp having an upper surface having an average inclination in the flow direction and in which the upper surface of the ramp and the upper surface of the counter-ramp form an angle less than 180° and the counter-ramp having a flow-promoting transition to the ramp at an upstream end, and a base arranged downstream of the ramp and the counter-ramp, and having a bottom which is arranged lower by a height dimension than the downstream end of the ramp and/or upstream end of the counter-ramp;

wherein the counter-ramp has a rigid plate-like structure hinged on the downstream end of the ramp and an angle adjustment mechanism, and wherein a flexible plate-like structure is arranged in the flow direction over the rigid plate-like structure of the counter-ramp, the flexible plate-like structure has at its upstream end a tangential transition to the plate-like structure of the counter-ramp.

2. The arrangement according to claim 1, wherein the ramp can be adjusted in its inclination in the flow direction.

3. The arrangement according to claim 1, wherein the inclination of the ramp in the flow direction can be adjusted between a smallest mean slope from 1:20 to 1:8 and a maximum mean slope from 1:8 to 1:1.

4. The arrangement according to claim 1, wherein the ramp has a constant slope in the flow direction or a decreasing slope.

5. The arrangement according to claim 1, wherein the counter-ramp can be adjusted in its inclination in the flow direction.

6. The arrangement according to claim 1, wherein an angle of the average inclination of counter-ramp to the horizontal in flow direction can be adjusted between a smallest angle from −45° to 0° up to a largest angle from 15° to 90°.

7. The arrangement according to claim 1, wherein a side of the counter-ramp facing the flow has a constant or increasing inclination in the flow direction.

8. The arrangement according to claim 1, wherein the ramp has an upstream wall, a rigid plate which is hinged to the upstream wall, and a mechanism for height adjustment of plate.

9. The arrangement according to claim 8, wherein the height of the upstream wall of ramp can be adjusted.

10. The arrangement according to claim 1, further comprising flow-affecting structures that reduce the flow speeds at the boundaries of the standing waves, the flow-affecting structures arranged on the flow-delimiting lateral surfaces of the arrangement in the vicinity of the counter-ramp.

11. The arrangement according to claim 1, further comprising flow-affecting structures that reduce the flow speeds of the standing waves arranged in a main flow in the vicinity of the counter-ramp.

12. The arrangement according to claim 1, wherein a means are provided for supplying compressed gas in the form of gas bubbles in the flowing medium in the vicinity of ramp, and/or adjacent the transverse structure, by means of which the form of appearance of linear standing waves changes in the subsequent region in the flow direction.

13. The arrangement according to claim 12, wherein the means for supplying compressed gas is designed such that supply is performed in the vicinity of ramp and/or adjacent the transverse structure at different times at alternating positions.

14. The arrangement according to claim 1, further comprising a height-adjustable flow-guiding element, arranged at least approximately perpendicular to the flow direction in the downstream region of the base, that directs the flow such that no eddies are produced there having pronounced flow components counter to the main flow in the flow direction.

15. The arrangement according to claim 14, wherein the flow-guiding element can be adjusted from a minimum height of 0 to 0.5 times the height of the height dimension up to a maximum height of 0.6 to 1.5 times the height of the height dimension above the base.

16. The arrangement according to claim 14, wherein the flow-guiding element has a rigid structure hinged to the upstream end of the base and has a height adjustment mechanism.

17. The arrangement according to claim 14, wherein the flow-guiding element has a tubular element which changes its shape due to internal pressurization.

18. The arrangement according to claim 14, wherein the flow-guiding element is mounted on a horizontal plate which can be displaced along the base in the flow direction.

19. An arrangement for producing linear standing waves in a flowing medium having a flow direction, said arrangement comprising:

a transverse structure arranged at least substantially perpendicular to the flow direction, the transverse structure being designed such that an outflow is converted from a streaming flowing movement into a shooting flowing movement, a ramp connected downstream of the transverse structure, the ramp having an upper surface being inclined at least substantially in the flow direction, a counter-ramp arranged at least substantially in the flow direction at a downstream end of the ramp, the counter-ramp having an upper surface having an average inclination in the flow direction and in which the upper surface of the ramp and the upper surface of the counter-ramp form an angle less than 180° and the counter-ramp having a flow-promoting transition to the ramp at an upstream end, and a base arranged downstream of the ramp and the counter-ramp, and having a bottom which is arranged lower by a height dimension than the downstream end of the ramp and/or upstream end of the counter-ramp;

wherein the counter-ramp has a tubular element which changes its shape due to internal pressurization.

* * * * *